US005989067A

United States Patent [19]

Morgan et al.

[11] Patent Number: 5,989,067

[45] Date of Patent: Nov. 23, 1999

[54] HALOGEN LAMP PIN SHROUD

[75] Inventors: David Morgan, London, United Kingdom; Michael O'Boyle, South Dartmouth, Mass.

[73] Assignee: Lightolier, Fall River, Mass.

[21] Appl. No.: 09/016,162

[22] Filed: Jan. 30, 1998

[51] Int. Cl.[6] ..... H01J 9/03

[52] U.S. Cl. ..... 439/617; 174/53; 174/135; 174/138 G

[58] Field of Search ..... 174/52.1, 52.4, 174/138 G, 135, 53; 439/336, 617, 618; 362/226

[56] References Cited

U.S. PATENT DOCUMENTS

| | | | |
|---|---|---|---|
| 2,892,992 | 6/1959 | Grovemiller et al. | 439/619 |
| 2,953,769 | 9/1960 | Woofter et al. | 439/611 |
| 3,092,695 | 6/1963 | Abrams | 200/51 R |
| 3,425,027 | 1/1969 | Uberbacher et al. | 313/318.05 |
| 3,555,341 | 1/1971 | Curtis et al. | 313/318 |
| 3,898,506 | 8/1975 | Willoughby et al. | 313/318 |
| 3,974,370 | 8/1976 | Pearson . | |
| 4,100,448 | 7/1978 | Chipner | 313/318 |
| 4,259,785 | 4/1981 | Wortham | 33/528 |
| 4,293,733 | 10/1981 | Royer | 174/67 |
| 4,463,278 | 7/1984 | Kosmatka | 313/318 |
| 4,473,770 | 9/1984 | Baba et al. | 313/318 |
| 4,769,574 | 9/1988 | Nagasawa | 313/318 |
| 4,803,396 | 2/1989 | Kelner | 313/318 |
| 4,849,670 | 7/1989 | Hellwig et al. | 313/318 |
| 4,864,183 | 9/1989 | Okano | 313/318 |
| 4,883,434 | 11/1989 | Toyoshima | 439/619 |
| 4,947,082 | 8/1990 | French | 313/318 |
| 5,008,588 | 4/1991 | Nakahara | 313/318 |
| 5,018,992 | 5/1991 | Bergin et al. | 439/699 |
| 5,065,069 | 11/1991 | Hunter | 313/325 |
| 5,286,223 | 2/1994 | Ogawa | 439/619 |
| 5,420,474 | 5/1995 | Schmitt | 313/318.1 |
| 5,538,443 | 7/1996 | Inoue et al. | 439/699.2 |
| 5,622,424 | 4/1997 | Brady | 362/226 |
| 5,683,254 | 11/1997 | Lin | 439/11 |
| 5,691,596 | 11/1997 | Yu | 313/318.1 |
| 5,709,571 | 1/1998 | Briski et al. | 439/699 |

*Primary Examiner*—Dean A. Reichard
*Assistant Examiner*—Dhirv R Patel
*Attorney, Agent, or Firm*—Hopgood, Calimafde, Kalil & Judlowe, LLP

[57] ABSTRACT

A protective device for use with a lamp holder for a high-voltage dual-pin lamp, such as a halogen lamp, includes a wall that surrounds the lower portion of an installed bi-pin lamp so as to prevent contact of the installer's fingers with the high-voltage pins. The protective device may also include a transverse rib that prevents the insertion of a low-voltage bi-pin lamp into a high-voltage lamp holder.

10 Claims, 3 Drawing Sheets

HALOGEN LAMP PIN SHROUD

The present invention relates generally to lamp holders, and more particularly to a holder for a high-voltage lamp that provides increased safety of installation and removal.

Halogen lamps have acquired increased acceptance and use because of their ability to produce a relatively intense light. In the conventional bi-pin type halogen lamp, the filament is connected to a supply voltage through a pair of generally parallel pins that extend from the lamp envelope. To install the lamp in a lamp holder by which the lamp is connected to a supply voltage, the lamp is typically held between the thumb and forefingers and the pins are inserted into (or removed from) openings formed in the lamp holder to which the supply voltage is applied. To remove the bi-pin lamp from the lamp holder, the process is reversed; that is, the upper part of the lamp is gripped by the thumb and forefingers, and the lamp is pulled out from the holder.

In the past, bi-pin halogen lamps of this type have operated with a relatively low, e.g, 12-volt, supply. There were no concerns that a potentially serious electrical shock could occur during the installation or removal of a low-voltage lamp from the holder as a result of an inadvertent contact of the installer's fingers with the pins and thus with the relatively low supply voltage. Recently, however, bi-pin halogen lamps have been developed that operate with a higher, to wit, 120-volt supply. This has created a need to prevent inadvertent contact of the lamp installer's fingers and the lamp pins that come in to electrical contact with the high-voltage supply.

As both 12-volt and 120-volt bi-pin halogen lamps are now available, the possibility exists that a 12-volt lamp might be mistakenly installed into a 120-volt holder or socket. Should this occur, the lower-voltage lamp operating at the higher supply voltage could explode creating the potential for serious damage to person and property.

SUMMARY OF THE INVENTION

It is an object of the invention to provide a protective device for use with a high-voltage bi-pin lamp and lamp holder that prevents inadvertent, potentially fatal contact with the lamp pins.

It is another object of the invention to provide a protective device of the type described for a high voltage lamp in which the insertion of a low-voltage bi-pin lamp into a high-voltage lamp holder is prevented.

To these ends, the protective device of the present invention includes a wall or shroud that surrounds the lower portion of an installed bi-pin lamp so as to prevent contact of the installer's fingers with the high-voltage pins. The protective device may also include a transverse rib associated with the shroud that prevents the inadvertent insertion of a low-voltage bi-pin lamp into a high-voltage bi-pin lamp holder.

To the accomplishment of the above and to such additional objects as may hereinafter appear, the present invention relates to a protective device for a bi-pin lamp as defined in the appended claims as considered along with the following detailed specification and the accompanying drawings in which:

DESCRIPTION OF THE PREFERRED EMBODIMENTS

Figure 1:
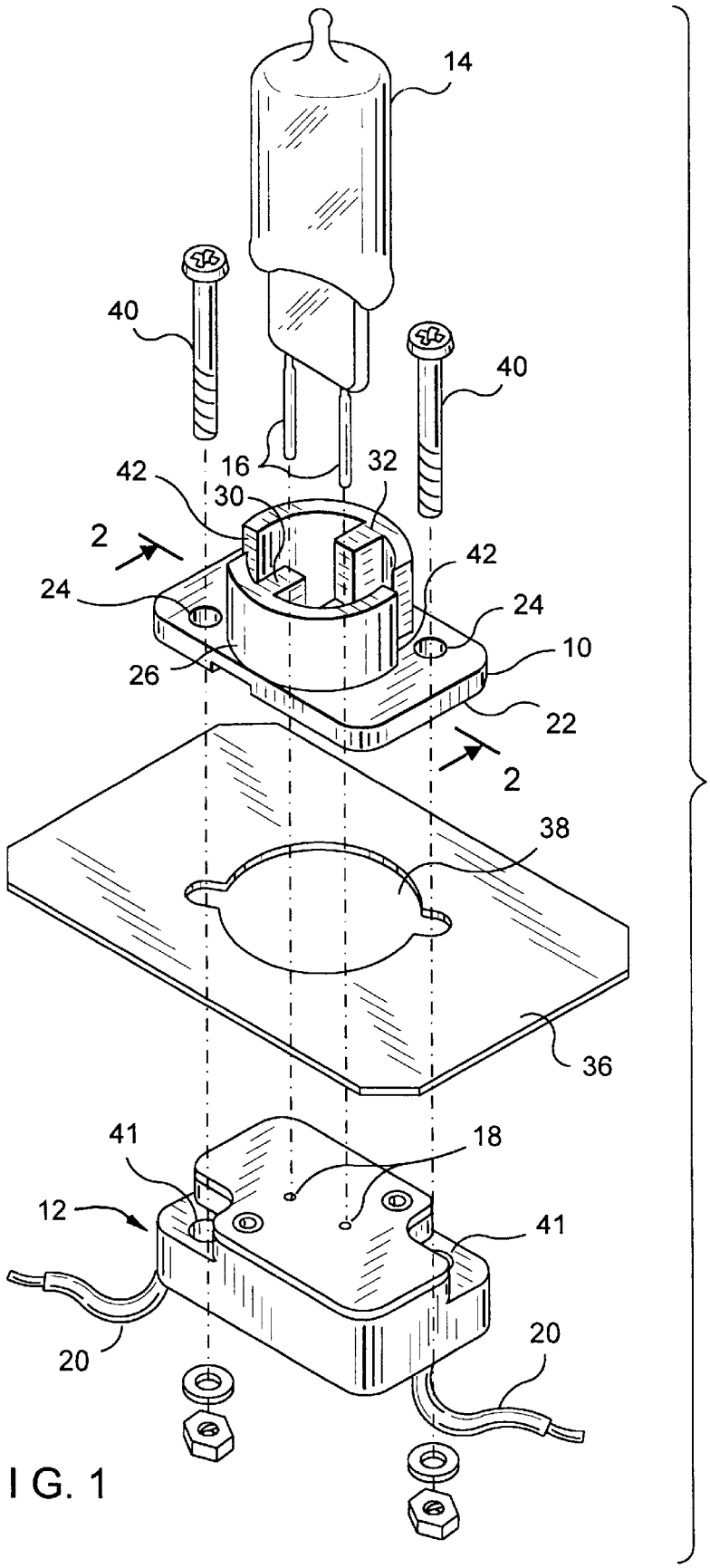
FIG. 1 is an exploded perspective view of a portion of a halogen lamp fixture that includes a protective device or shroud in accordance with a first embodiment of the invention.

As illustrated in the embodiment of FIG. 1, the protective device of the invention generally designated 10 is intended for use in a lighting fixture that includes a per se conventional lamp holder 12 intended to receive a bi-pin lamp such as a halogen lamp 14. As is also per se conventional, the pins 16 of lamp 14 are adapted to be received in openings 18 in lamp holder 12, which are connected to a pair of internal contacts (not shown) that are, in turn, connected to an external supply voltage by means of conductors 20.

Figure 2:
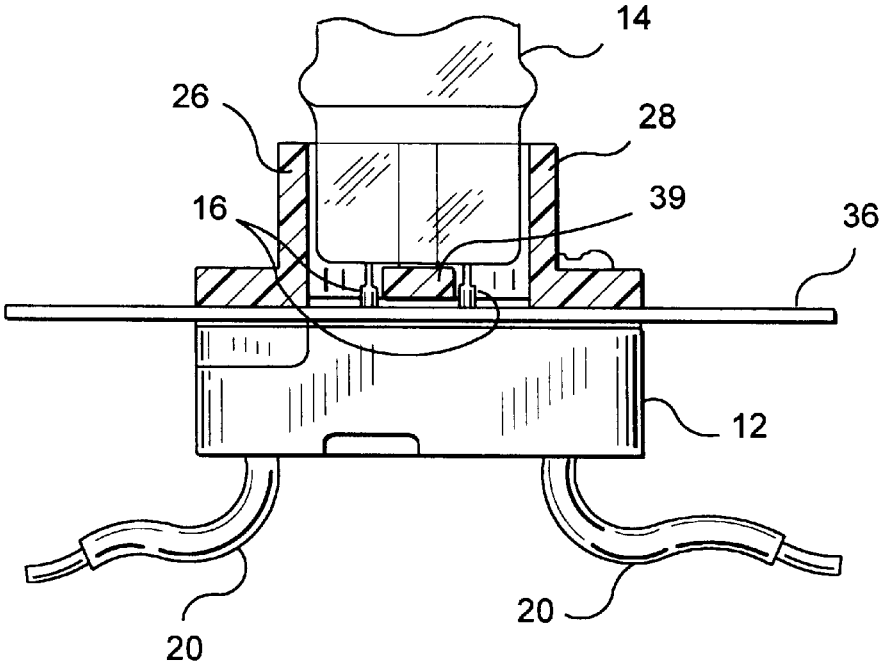
FIG. 2 is a cross-sectional view of the assembled protective device and lamp holder of FIG. 1 as viewed in the direction of the arrows 2—2 in FIGS. 1 and 3.
Figure 3:
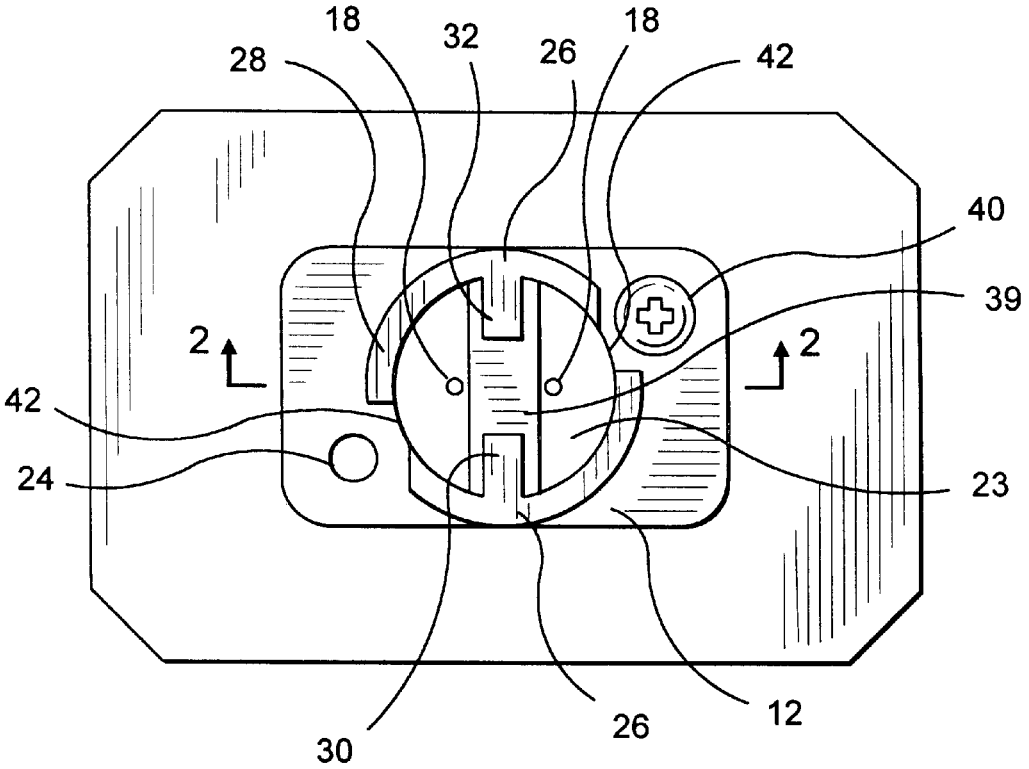
FIG. 3 is a top plan view of the protective device of the embodiment of FIG. 1.

In the event the supply voltage is high, typically in the order of 120 volts, contact between the fingers of the individual handling the lamp and the pins 16 of the lamp could cause a serious and possibly fatal shock to the individual. To prevent such contact, the present invention calls for the use of protective device or shroud 10 which, in the embodiment illustrated in FIGS. 1–3, includes a ceramic base 22 having an opening 23 (FIG. 3), and a pair of opposed openings 24 formed therein. Although base 22 is illustrated in the figures as being rectangular, it will be understood that it may be of another shape such as, for example, circular or square. A pair of opposed walls 26 and 28 project upwards from base 22. As shown in FIGS. 1 and 3, the ends of walls 26, 28 may be spaced by gaps 42. A pair of opposed ribs 30, 32 extend radially inwardly from walls 26, 28, respectively along a plane substantially perpendicular to the plane of lamp pins 16. A transverse rib 34 extends across central opening 23 between the lower ends of ribs 30, 32.

Shroud 10 may be, as shown, secured to a conventional fixture designated 36 and to lamp holder 12 by means of screws 40 that pass through openings 24 and aligned openings 42 in the lamp holder. Fixture 36 may be, for example, a reflector, bracket or enclosure wall. If desired, the shroud 10 may be secured to the fixture by other means such as a press fit or snap fit construction. If desired, protective shroud 10 may also be directly secured to the lamp holder 12 such as by means of fasteners 40. The radial ribs 30, 32 and the transverse wall 34 prevent the insertion of a low-voltage (e.g. 12-volt lamp), which has a different pin orientation, into the contact openings 18 of the lamp holder 12.

The pins of the lamp 14 may then be installed by hand by passing the lower end of the lamp through the openings on either side of rib 34 and into the lamp holder 12. In so doing, the lamp must be oriented so that the pins 16 are perpendicular to the ribs 30, 32 and the lower transverse wall 34 to allow them to be passed through the protective device 10 and then inserted within openings 18 in holder 12. When the lamp 14 is inserted in this manner into the lamp holder 12, the walls 26, 28 of the protective device 10 substantially encircle the lower end of the lamp 14 and the pins 16 so that inadvertent contact between the installer's fingers and the pins of the installed lamp is not possible. The gaps 42 between the walls 26, 28 are narrower than the width of the installer's fingers but wider than the lower end of the lamp 14 to allow the lower part of the lamp to be placed between the walls 26, 28 and urged downwardly by the installer for insertion of the pins into the lamp holder.

Figure 4:
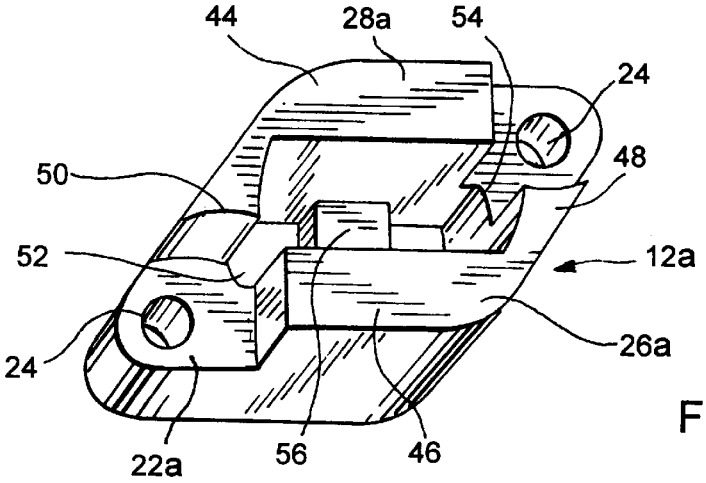
FIG. 4 is a perspective view of a protective device according to a second embodiment of the invention.
Figure 5:
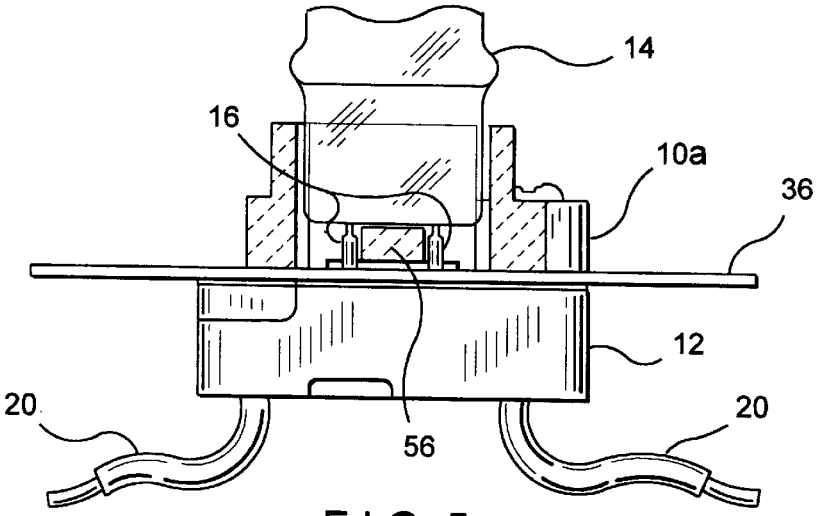
FIG. 5 is a cross-section of the protective device of FIG. 4 as viewed on the direction of the arrows 5—5 in FIGS. 4 and 6.
Figure 6:
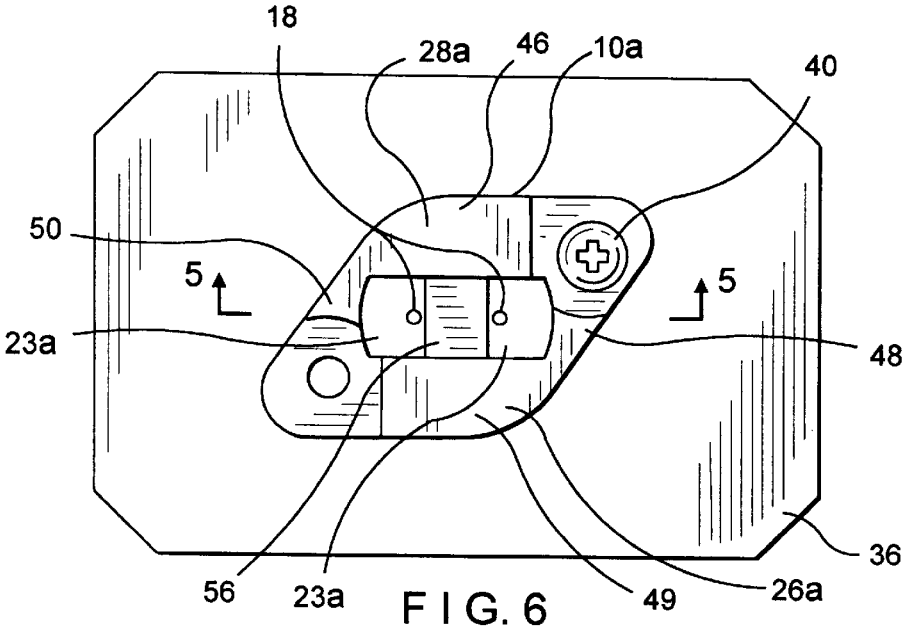
FIG. 6 is a top plan view of the protective device of FIG. 4.

In the embodiment of the invention illustrated in FIGS. 4–6, the protective device 10*a* includes a substantially elliptical or diamond-shaped base 22*a* in which opposed openings 24 are formed, as in the first-described embodiment. A pair of walls 26*a*, 28*a* extend upwardly from base 22*a* and surround a central opening 23*a* in the base. Walls 26*a*, 28*a*, which serve the same protective function as the walls 26, 28 in the embodiment of FIG. 1, include opposed main sections 44, 46 having arcuate ends at their outer peripheries which extend into curved end sections 48, 50, respectively. The free ends of walls 46, 48 may be spaced by gaps 52, 54, which are of a lesser width than the installer's fingers, as in the embodiment of FIG. 1. A transverse rib 56 extends between the lower ends of walls 46, 48 and between openings 23*a* to prevent the insertion of a low-voltage bi-pin lamp through the opening 23*a*.

The protective device or shroud of the present invention prevents inadvertent contact between the installer's fingers and the high-voltage on the lamp pins as desired. Although the present invention is described hereinabove with respect to presently preferred embodiments, modifications, such as in the shape of the shroud base and walls. Further, although the shroud of the invention is hereinabove described for use with a permanent fixture, it may also be used in a portable lamp to similar advantage. It will thus be understood that modifications may be made to the described embodiments without necessarily departing from the spirit and scope of the invention.

What is claimed is:

1. A protective device for use with a lamp holder or lighting fixture and a dual-pin lamp to prevent inadvertent contact between a lamp installer and the lamp pins, said protective device comprising an insulated base adapted to be secured to the lamp holder or fixture surface and having a central opening to allow the spaced lamp pins to pass through and to be inserted into spaced openings formed in the lamp holder, and at least one wall at least partially surrounding said central opening and extending upwardly from said base, said wall at least partly encircling the lower end of the lamp by a sufficient amount and being of a sufficient height so as to prevent contact between the lamp installer and the pins of the lamp as the lamp is inserted through said protective device and into the lamp holder.

2. The protective device of claim 1, in which said protective device includes a pair of spaced substantially arcuate walls extending from said base, said walls being spaced by a gap that is large enough to allow insertion of the lamp therein but small enough to prevent the installer's fingers from contacting the pins of the lamp through said gap.

3. The protective device of claim 2, further comprising a transverse rib extending between the lower ends of said walls in a plane substantially perpendicular to the plane of the lamp pins.

4. The protective device of claim 3, further comprising first and second walls respectively extending radially inwardly from said walls and contiguous with spaced sections of said transverse rib.

5. A protective device for use with a lamp holder or a lighting fixture and a dual-pin lamp to prevent inadvertent contact between a lamp installer and spaced lamp pins, said protective device comprising an insulated base adapted to be secured to the lamp holder or fixture surface and having a central opening to allow the spaced lamp pins to pass through and to be inserted into spaced openings formed in the lamp holder, a pair of spaced arcuate walls extending upwardly from said base and substantially surrounding said central opening and the lower end of the lamp, said walls each being of a sufficient height to prevent contact between the lamp installer's fingers and the pins of the lamp when the lamp is inserted into the lamp holder.

6. The protective device of claim 5, further comprising a transverse rib extending between the lower ends of said walls in a plane substantially perpendicular to the plane of the lamp pins.

7. The protective device of claim 6, further comprising first and second walls respectively extending radially inwardly from said walls and contiguous with spaced sections of said transverse rib.

8. The protective device of claim 5, in which said walls are spaced by a gap that is large enough to allow insertion of the lamp therein but small enough to prevent the installer's fingers from contacting the pins of the lamp through said gap.

9. The protective device of claim 8, further comprising a transverse rib extending between the lower ends of said walls in a plane substantially perpendicular to the plane of the lamp pins.

10. The protective device of claim 9, further comprising first and second walls respectively extending radially inwardly from said walls and contiguous with spaced sections of said transverse rib.

* * * * *